US005804793A

United States Patent [19]

Faroldi

[11] Patent Number: 5,804,793

[45] Date of Patent: Sep. 8, 1998

[54] APPARATUS FOR HEATING RAILS DURING THE LAYING DOWN THEREOF

[76] Inventor: Bruno Faroldi, Via Berenini 119, I-43036 Fidenza, Italy

[21] Appl. No.: 632,447

[22] PCT Filed: Aug. 14, 1995

[86] PCT No.: PCT/EP95/03227

§ 371 Date: Apr. 18, 1996

§ 102(e) Date: Apr. 18, 1996

[87] PCT Pub. No.: WO96/06981

PCT Pub. Date: Mar. 7, 1996

[30] Foreign Application Priority Data

Aug. 26, 1994 [IT] Italy ..... TO94A0679

[51] Int. Cl.[6] ..... H05B 1/00; E01B 7/08

[52] U.S. Cl. ..... 219/201; 104/2

[58] Field of Search ..... 219/201, 202, 219/205; 104/2–17; 105/451; 322/90, 91

[56] References Cited

U.S. PATENT DOCUMENTS

| | | | |
|---|---|---|---|
| 3,793,544 | 2/1974 | Baumgartner et al. | 322/90 |
| 3,896,734 | 7/1975 | Plasser et al. | 219/213 |
| 3,999,276 | 12/1976 | Brown et al. | 104/2 |
| 4,339,704 | 7/1982 | McSparran et al. | 322/90 |
| 4,429,845 | 2/1984 | Stover et al. . | |
| 4,656,333 | 4/1987 | Murphy | 219/201 |
| 4,815,052 | 3/1989 | Walker | 322/90 |
| 5,004,190 | 4/1991 | Montierth et al. | 105/451 |
| 5,181,472 | 1/1993 | Scheuchzer | 104/2 |
| 5,299,504 | 4/1994 | Abele . | |

FOREIGN PATENT DOCUMENTS

| | | |
|---|---|---|
| 0 551 798 | 7/1993 | European Pat. Off. . |
| 172929 | 2/1935 | Switzerland . |

*Primary Examiner*—Teresa J. Walberg
*Assistant Examiner*—Sam Paik
*Attorney, Agent, or Firm*—Young & Thompson

[57] ABSTRACT

An apparatus for heating railway rails during the laying down thereof, which comprises: a group (1–5) generating a direct current, mounted on a railway car (A); a pair of first contact vices (7) carried by this railway car (A), connected to the output of the generator group (1–5) and suitable for being tightened each one on a first end of the two rails (R) forming the railway track section to be heated; a trolley (B) provided with a similar pair of second contact vices (13), connected to one another and suitable for being tightened on a second end, opposite the first end, of the two rails (R) forming the railway track section to be heated; and means (8–12) for controlling the electric power delivered by the generator group (1–5) in order to produce in the considered railway track section a heating up to a prefixed temperature. Preferably, the group (1–5) generating direct current comprises (1), an alternator (2) moved by the motor (1), a transformer (4) for the current delivered by the alternator (2) and a power rectifier bridge (5) arranged for converting the alternating current coming from the transformer (4) into a direct current to be supplied to the first contact vices (7).

8 Claims, 3 Drawing Sheets

APPARATUS FOR HEATING RAILS DURING THE LAYING DOWN THEREOF

This invention refers to an apparatus for heating railway rails during the laying down thereof.

When a long rail section is laid down in conditions of constrained thermal expansion, according to the presently preferred art, in order to prevent the troubles which, when the temperature of the rail changes, could be caused by an excessive expansion or contraction with respect to the conditions at the time of laying down, it is needed that the condition of absence of longitudinal strain (the so-called "null strain condition") in the rail is made to correspond to a prefixed temperature which, for example, for certain railway systems is prescribed to be 30°C.±3° C. It would be immediate to obtain this condition if one could effect the laying down of the rails and the tightening of the means for fixing the same to the ties when the rail temperature corresponds to this prefixed temperature but, in general, suitable environment conditions for doing so are not verified, and the actual temperature of laying down is lower than the prescribed temperature; therefore, conventionally the so-called "regulation" of the rail is effected, which comprises applying to the rail, by means of a mechanical traction, an expansion calculated in such a manner as to generate in the rail the same internal strain conditions which would be verified, in the same temperature conditions, in case the rail would have been laid down at the prescribed temperature.

According to a manner of operation, which can be deemed the most usual one, when replacing the rails, some rail sections of unitary length, usually in the length of 36 meters as they come from the hot-drawing, are laid down and fixed without welding them, thus forming a railway track which is temporarily used in these poor conditions. At a later time these rail sections are welded together to form sections separated from the one another by a free joint intended to form the regulation point, and the members for fixing the rails to the ties are loosened. Special tensioning clamps are installed in the regulation point, and by means of them the facing ends of the sections are drawn the one towards the other until the rail section receives an extension calculated as the product of the section length multiplied for the thermal expansion coefficient of the rail and for the difference between the actual temperature of the rail at the time of the regulation, and the prescribed temperature. At this point, the facing ends of the rail sections are welded together and all the members for fixing the rail to the ties are tightened.

The described operations require interrupting the traffic of the trains on the considered railway track; both the needed operations and the time during which the traffic is interrupted give rise to a heavy economical, technical and organization burden, as well as the period during which the traffic takes place on the poor railway track formed before the regulation, also involving a certain degree of danger; whereby the rail regulation still represents an open problem.

It would therefore be highly desirable that the regulation of the rails forming a railway track could be effected at the same time as their laying down, by heating the rails until a temperature higher than the environmental one, in order that the tightening of the members connecting the rails to the ties could take place at the very prescribed temperature. To this aim it has been proposed to heat the rails during their laying down by means of free flames, of heating apparatuses acting by irradiation or by electric induction means, but no one of these means allows obtaining a sufficient evenness in the rail heating along the whole length of the considered section; moreover, the needed installations are too expensive. It has also been proposed, in general, to heat the rails by means of the Joule effect, by having an electric current pass through the rails. However, even if this principle is very rational in theory, it has turned out that by proceeding, as it appears obvious, with alternating currents which may be locally generated with ease, the skin effect produced by the ferromagnetic character of the material forming the rails gives rise to a lack of evenness in the current passing through the cross section of the rails, with the consequent concentration of the heating in the more superficial regions of the rails; moreover, the electric voltages needed for proceeding this way on a railway track of, for example, 144 meters of length, as usual, are not allowable for reasons of safety.

This invention has the aim to solve in a technically rational and economically convenient manner the above stated problem, by creating an installation for heating railway rails which, by using the known principle of heating the rails by means of the Joule effect, should be free from the stated disadvantages.

This aim is attained, according to the invention, by means of an apparatus which comprises: a group generating a direct current, mounted on a railway car; a pair of first contact vises carried by said railway car, connected to the output of said generator group and suitable for being tightened each one on a first end of the two rails forming the railway track section to be heated; a trolley provided with a similar pair of second contact vises, connected the one another and suitable for being tightened each one to on a second end of the two rails forming the railway track section to be heated, opposite said first end; and means for controlling the electric power delivered by said generator group in order to produce in the considered railway track section a heating up to a prefixed temperature.

Preferably, said group generating direct current comprises a motor, an alternator powered by said motor, a transformer for the current delivered by said alternator, and a power rectifier bridge arranged for converting the alternating current coming from said transformer into a direct current to be supplied to said first contact vises.

Preferably said motor is an autonomous Diesel engine or, alternatively, it is the same engine which drives the apparatus, if this latter is provided with motor means.

Preferably said alternator is of a type having controlled excitation, and some current sensors are inserted between the output of said rectifier bridge and said first contact vises, some temperature sensors are applied to an intermediate point of said railway track section, and a process controller is provided for receiving the signals emitted by said sensors and for controlling consequently the excitation of said alternator.

Preferably, said alternator is a three-phase alternator, and it includes a three-phase excitator with an inductor, a polar wheel comprising a rectifier bridge and an inductor winding, and three stator windings.

Preferably, moreover, safety control means are connected to said process controller in order to interrupt the operation of the apparatus in case circumstances which are abnormal or capable of causing inconveniences or danger are verified.

Preferably said contact vises are formed by jaws profiled in a manner corresponding to the rail section and operated by hydraulic motors.

These and other features, objects and advantages of the subject of the present invention will be more clearly apparent from the following description of an embodiment, having the non limitative character of an example, of an apparatus according to the invention, diagrammatically represented in the appended drawings, wherein.

As already said, the use of the Joule effect for heating rails by means of electric currents passing through them has been already proposed, but the experiments made in this respect did not give satisfactory results. From the searches and experiments done by the Applicant it has turned out that these disappointing results were essentially due to the use of alternating currents. Making use of alternating currents in this application seems to be evident, because the needed energy should be generated locally by means of generators which, as a rule, include a motor and an alternator. But the alternating current applied to the rails, whose constituting material is ferromagnetic, gives rise to an intensive skin effect, whereby practically the current flows only in a region having a little depth from the external surface of the rail. Only in this region the heat is generated, whereby the rail heating can in no way be uniform in its section, and on the other hand the reduced cross section useful for the current flow gives rise to an increased apparent resistivity of the rail, to which ensues the need of having recourse to relatively high voltages, which cannot be allowed for safety reasons. This is the reason for which the present invention proposes, on the contrary, to use a direct current, what at first sight could appear as a unnecessary-complication.

Such a direct current may be produced by means of a special generator including a dynamo instead of an alternator, but according to the invention it is preferable to have recourse to a usual generator which produces an alternating current, and then to convert this alternating current into a direct current, preferably by means of a static power rectifier bridge.

Figure 1:
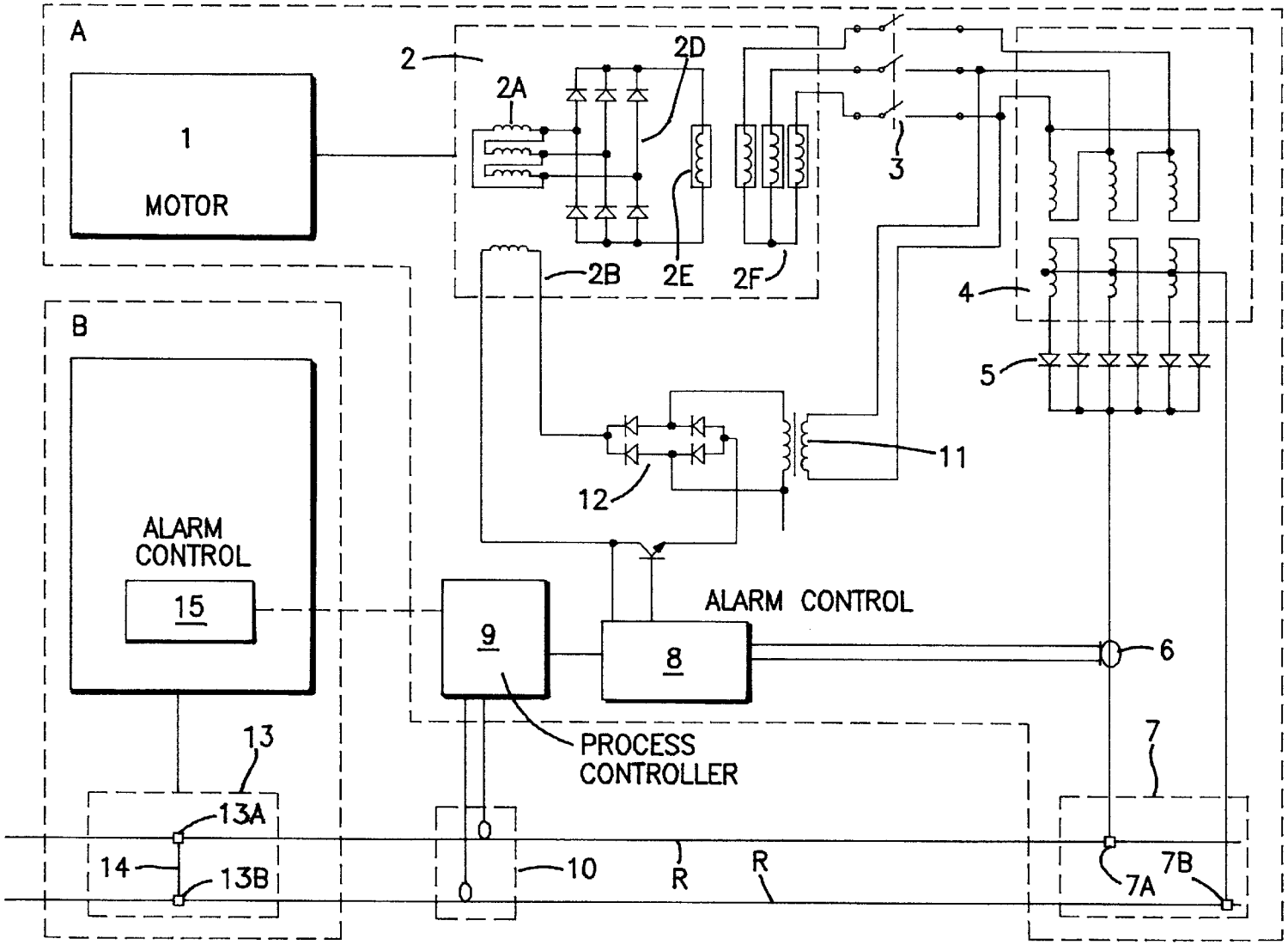
FIG. 1 shows a block diagram of the apparatus according to the invention.

With reference to FIG. 1, a preferred embodiment of the invention comprises, mounted on a railway car A (not shown as such in this Figure but only in FIGS. 2 to 5, and diagrammatically shown in FIG. 1 by a square), the component parts shown in said square A. These component parts include first of all a motor 1 which mechanically drives an alternator 2, whose delivered current may be allowed or intercepted by means of a switch 3. The motor 1 may be, for example, an autonomous Diesel engine, or, if the railway car carrying the apparatus is self-driving, the motor 1 may be the same motor driving the railway car. In the shown case, the alternator 2 is a three-phase alternator and it includes a three-phase excitator 2A comprising an inductor 2B, a polar wheel with a rectifier bridge 2D and an inductor winding 2E, and three induced stator wind ings 2F.

The switch 3 is followed by a three-phase transformer 4, intended to generate the relatively low voltage needed for the operation of the apparatus, whereas a power rectifier bridge 5, formed by static elements, converts the electric current locally generated, which up to this point was a three-phase alternating current, into a direct current. The delivered current is measured by means of a current sensor 6, then it is forwarded to a contact group 7 intended to transmit the current to the rails R forming the railway track section to be heated. To this purpose, the contact group 7 includes two contact vises 7A and 7B, which are tightened respectively onto the two rails R of the railway track. Taking into account the high currents to be transmitted, these contact vises are preferably formed by jaws profiled in a manner corresponding to the cross sec- tion of the rails and operated by hydraulic motors.

Moreover, the apparatus according to the invention includes a railway trolley 3 (shown as such only in the FIGS. 2 to 5, and diagrammatically shown in FIG. 1 by a square), which carries a contact group 13 similar to the already described contact group 7, and comprising two contact vises 13A and 13B similar to the contact vises 7A and 7B, which however, instead of being connected to an electric energy supply, are connected to one another by a bridge 14.

As it may be understood, when the two contact groups 7 and 13 are connected to the rails R at the opposite ends of the railway track section to be heated, and the apparatus is operated, the current delivered through the rectifier 5 passes along a first rail R between the contact vise 7A and the contact vise 13A, the bridge 19 between the contact vises 13A and 13B, then the second rail R between the contact vise 13B and the contact vise 7B, and it heats these rails R by Joule effect. Because the current is direct, the conduction and the heating uniformly involve the whole cross section of the rails R, thus radically avoiding the disadvantages verified in the case of using alternating currents.

One phase of the three-phase voltage generated by the induced stator windings 2F of the alternator 2 supplies, through a transformer 11 and a diode bridge 12, the inductor winding 2B of the excitator 2A for the alternator 2. Preferably the excitation is controlled by a device 8 controlling the alternator excitation, under control of the signal coming from the current sensor 6 and of a process controller 9 to which are also sent the signals coming from the temperature sensors 10, suitably applied to the rails R in at least one intermediate point of the railway track section to be heated. To the process controller 9 may also advantageously be forwarded the signal of an alarm control device 15, mounted on the trolley B and having the purpose of interrupting the operation of the apparatus when any circumstance is verified, that is abnormal or is capable of causing inconveniences or danger. Therefore the process controller 9, after having compared the rail temperature values given by the sensors 10 with a value imposed by the operator, and only with the consent of the alarm control device 15, controls the electric power applied to the rails R by acting on the alternator excitation control 8. Thanks to the signal coming from the current sensor 6, the delivered power may be regulated until the temperature imposed by the operator is actually obtained, and then maintained, in the rails R.

In the FIGS. 2 to 5 there are represented different steps of the operation of apparatus A,B according to the invention, on rails R being laid down, this apparatus being synchronized with apparatuses S for welding the rails and with apparatuses T for arranging the ballast, in view of the fact that in most cases these different operations are to be effected at the same time. The apparatus according to the invention may be inserted in a railway line renewal train, between the apparatuses for laying down the new rails and the apparatuses for welding the same.

Figure 6:
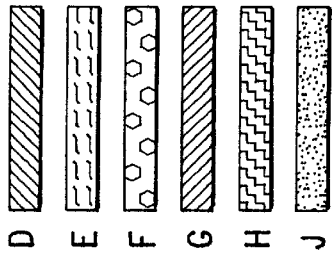
FIG. 6 shows the symbols used for distinguishing the various regions of the railway track under treatment.

The various regions of the line, on which the different operations are carried out, are identified by special underlying hatches, whose significance is clarified by FIG. 6 as follows: D=section where the end step of the operations is in course; E=section where the step of arranging the ballast and fixing the rails on the ties is in course; F=section where the rails are being laid down; G =section of railway track where the heating is in course or is foreseen; H=hot railway track section; J=last section laid down during the foregoing operation (in most cases, the day before).

As it may be understood, the operations proceed from left to right according to the Figures.

Figure 2:
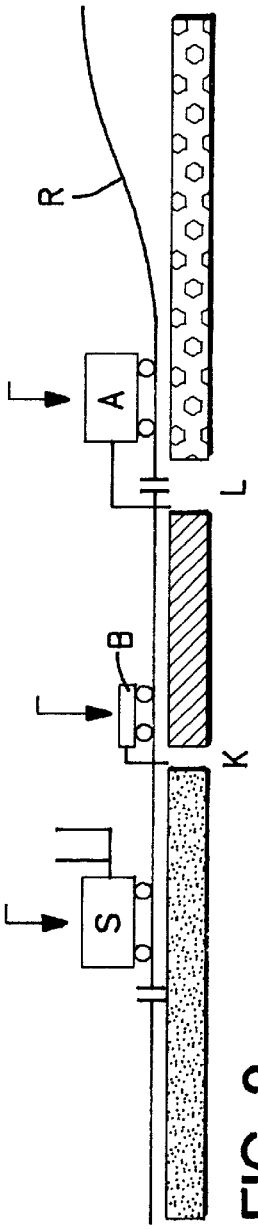
FIGS. 2 to 5 show different steps of the operation of this apparatus.
Figure 3:
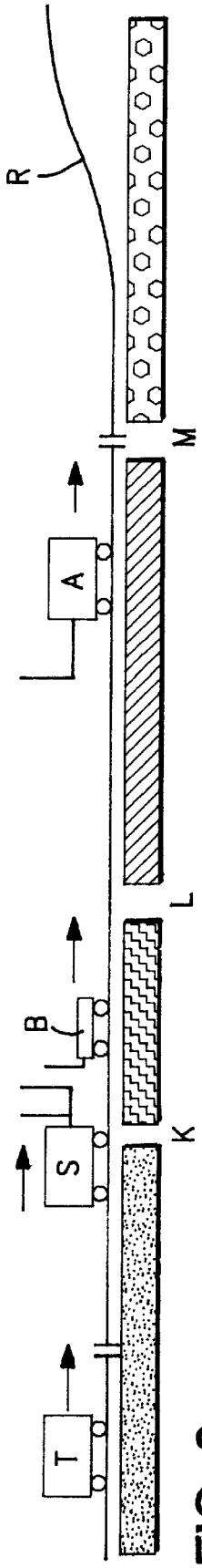
Figure 4:
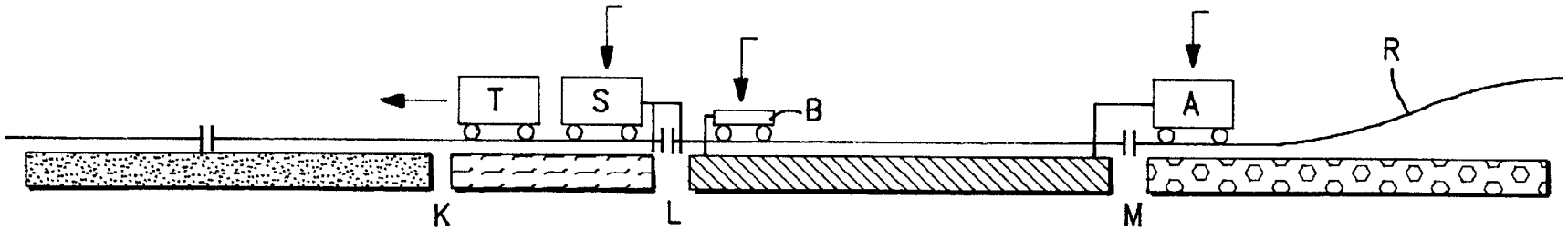
Figure 5:
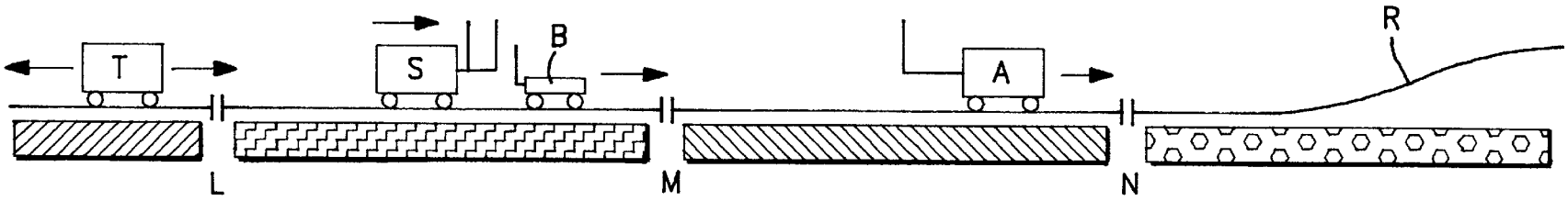

FIG. 2 shows that when starting the operation it is of advantage to heat a railway track section K-L already laid down during the foregoing operation, in order to attain a uniform regulation at the passage from the already laid down rails to the rails being laid down at present. FIG. 3 shows that, when completed the previous heating of the section K-L according to FIG. 2 is completed, the apparatuses A,B are advanced (towards the right) for heating a new railway track section L-M (which in the meantime has been laid down), whilst the welding machine S advances for welding the joint L and the ballast arranging machine T advances too, behind the welding machine S, for operating on the railway track section already welded and fixed; the operations effected after the advancement according to FIG. 3 are represented in FIG. 4. When these operations are completed, a new step of advancement takes place for heating a further section of railway track M-N, which in the meantime has been laid down (FIG. 5).

An example of the operating conditions of an apparatus according to the invention will now be set forth, but it should be understood that the best operating conditions are to be determined for each case by taking into account the actual rail characteristics and the environmental conditions. The following example refers to operations effected on rails of the type 60 UNI and on a railway track section of 144 meters.

Cross section of the rail: 7866 square millimeters

Winsor weight: 60 kilograms/meter

Total weight of the section: 17280 kilograms

Specific resistance: 20.82 microohm/meter

Approximate total resistance: 6 milliohm

Desired temperature change: 45 degrees centigrade

Desired duration of the operation: 15 minutes

Approximate power needed: 408 kilowatt

Linear surface of the track section: 0.68 $m^2$/meter

Dispersed power: 246 watts/square meter

Specific dispersed power: 167 watt/meter

Total dispersed power: 50 kilowatt

Total power needed: 460 kilowatt

Current intensity in the track section: 8800 ampere

Maximum voltage at the ends of the section: 52 volt

Minimum gradient of temperature change: 3° C./minute

It will clearly appear to those skilled in the art, when informed by the present description about the principles and the characteristics of the invention, in which manner the operating conditions specified above by way of example should be modified when the starting conditions are different.

The application of this invention allows an effective thermal regulation of the rails laid down during the installation or the renewal of a railway line, by means of relatively quick and cheap operations, which may be organized with ease at the time of effecting the other required operations.

Although one embodiment only of the invention has been described, it will clearly appear to those skilled in the art that this invention may accept several changes and replacements by technically equivalent means, without departing from the spirit of the invention and the scope of the appended Claims.

I claim:

1. Apparatus for simultaneously heating two rails (R) forming a track section, during the laying down thereof, which comprises: a railway car (A); a generator group (1–5) generating a direct current, mounted on said railway car (A); a pair of first contact vises (7) carried by said railway car (A), connected to an output of said generator group (1–5) and suitable for being tightened one on a first end of one of said two rails (R) and the other on a first end of the other of said two rails (R) forming the railway track section to be heated; a trolley (B); a pair of second contact vises (13) mounted on said trolley (13), connected to one another and suitable for being tightened one on a second end of one said two rails (R) and the other on a second end of the other of said two rails (R) forming the railway track section to be heated, opposite said first end; and means (8–12) for controlling the electric power delivered by said generator group (1–5) in order to produce in said railway track section to be heated a heating up to a prefixed temperature by passing electric power through said one rail in one direction and simultaneously through said other rail in an opposite direction.

2. Apparatus as set forth in claim 1, wherein said group (1–5) generating direct current comprises a motor (1) , an alternator (2) powered by said motor (1), a transformer (4) for the current delivered by said alternator (2), and a power rectifier bridge (5) arranged for converting the alternating current coming from said transformer (4) into a direct current to be supplied to one of said first contact vises (7).

3. Apparatus as set forth in claim 2, wherein said motor (1) is an autonomous Diesel engine.

4. Apparatus as set forth in claim 2, wherein further comprises motor means including an engine which drives the apparatus, and said motor (1) is the same engine which drives the apparatus.

5. Apparatus as set forth in claim 2, wherein said alternator (2) is of a type having controlled excitation, and the apparatus comprises some current sensors (6) inserted between the output of said rectifier bridge (5) and said one of said first contact vises (7), some temperature sensors (10) applied to an intermediate point of said railway track section to be heated, and a process controller (9) arranged for receiving signals emitted by said sensors (6,10) and for controlling consequently the excitation of said alternator (2).

6. Apparatus as set forth in claim 2, wherein said alternator (2) is a three-phase alternator, and it includes a three-phase excitor (2A) having an inductor (2B), a polar wheel comprising a rectifier bridge (2D) and an inductor winding (2E), and three stator windings (2F).

7. Apparatus as set forth in claim 5, which includes safety control means (15) connected to said process controller (9) in order to interrupt the operation of the apparatus in case circumstances which are abnormal or capable of causing inconveniences or danger are verified.

8. Apparatus as set forth in claim 1, wherein said contact vises (7,13) comprise jaws profiled in a manner corresponding to the rail sections (R) and hydraulic motors operating said jaws.

* * * * *